US010709276B2

(12) United States Patent
Guanch et al.

(10) Patent No.: US 10,709,276 B2
(45) Date of Patent: Jul. 14, 2020

(54) COLLAPSIBLE DELIVERY STORAGE ASSMEBLY

(71) Applicants: Daniel Guanch, Miami, FL (US); Jerry Diaz, Miami, FL (US)

(72) Inventors: Daniel Guanch, Miami, FL (US); Jerry Diaz, Miami, FL (US)

( * ) Notice: Subject to any disclaimer, the term of this patent is extended or adjusted under 35 U.S.C. 154(b) by 154 days.

(21) Appl. No.: 15/961,081

(22) Filed: Apr. 24, 2018

(65) Prior Publication Data

US 2019/0320836 A1 Oct. 24, 2019

(51) Int. Cl.
*A47G 29/20* (2006.01)
*A47G 29/14* (2006.01)

(52) U.S. Cl.
CPC ..... *A47G 29/20* (2013.01); *A47G 29/141* (2013.01)

(58) Field of Classification Search
CPC .... A47G 29/124; A47G 29/141; A47G 29/16; A47G 29/20; A47G 2029/144; A47G 2029/148; B65D 7/26; B65D 7/24; B65D 21/086; E05B 65/0075
USPC ..... 232/17, 19, 38, 45, 1 E; 220/6; 70/63
See application file for complete search history.

(56) References Cited

U.S. PATENT DOCUMENTS 2,456,479 A 12/1948 Antil
2,750,105 A * 6/1956 Wixom ..... A47G 29/12 232/19
5,774,053 A * 6/1998 Porter ..... A47G 29/141 232/19
6,375,070 B1 4/2002 Snoke
6,426,699 B1 * 7/2002 Porter ..... A47F 10/00 221/2
6,540,134 B1 4/2003 Rasche
6,612,489 B2 9/2003 McCormick
6,959,858 B2 * 11/2005 Stagnaro ..... A47G 29/12 232/19
9,364,112 B2 6/2016 Sundarsan
10,076,204 B1 * 9/2018 Sadeghi ..... A47G 29/141
10,321,780 B1 * 6/2019 James ..... A47G 29/16
2001/0040422 A1 * 11/2001 Gramlich ..... A47G 29/141 312/234
2003/0006275 A1 1/2003 Gray
2013/0077896 A1 * 3/2013 Wiley ..... B65D 33/00 383/86.2
2014/0008246 A1 1/2014 Pfeiffer
2016/0068306 A1 * 3/2016 Heinz ..... B65D 21/086 220/560.01
2016/0331171 A1 * 11/2016 Jiang ..... G06Q 10/0833
2017/0127868 A1 * 5/2017 Adewuyi ..... A47G 29/141
2017/0188737 A1 * 7/2017 Hippert ..... A47G 29/20
2017/0251856 A1 * 9/2017 Schaible ..... A47G 29/141
(Continued)

*Primary Examiner* — William L Miller

(57) ABSTRACT

A collapsible delivery storage assembly includes a panel that is mounted to an exterior wall of a building and the panel has a recess therein. A storage unit is movably coupled to the panel and the storage unit is positionable in a collapsed position having the storage unit being positioned in the recess. The storage unit is positionable in a deployed position such that the storage unit defines a box for receiving a package delivery. A door is hingedly coupled to the storage unit to close the box. A combination lock is coupled to the door and the combination lock releasably engages the storage unit when the door closes the box. Thus, the combination lock restricts access to the package in the box.

15 Claims, 8 Drawing Sheets

(56) References Cited

U.S. PATENT DOCUMENTS

2018/0296016 A1* 10/2018 Teoh ..... A47G 29/20
2019/0225375 A1* 7/2019 Sena ..... A47G 29/141

* cited by examiner

COLLAPSIBLE DELIVERY STORAGE ASSMEBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing package deliveries at a building.

BRIEF SUMMARY OF THE INVENTION

An embodiment of the disclosure meets the needs presented above by generally comprising a panel that is mounted to an exterior wall of a building and the panel has a recess therein. A storage unit is movably coupled to the panel and the storage unit is positionable in a collapsed position having the storage unit being positioned in the recess. The storage unit is positionable in a deployed position such that the storage unit defines a box for receiving a package delivery. A door is hingedly coupled to the storage unit to close the box. A combination lock is coupled to the door and the combination lock releasably engages the storage unit when the door closes the box. Thus, the combination lock restricts access to the package in the box.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
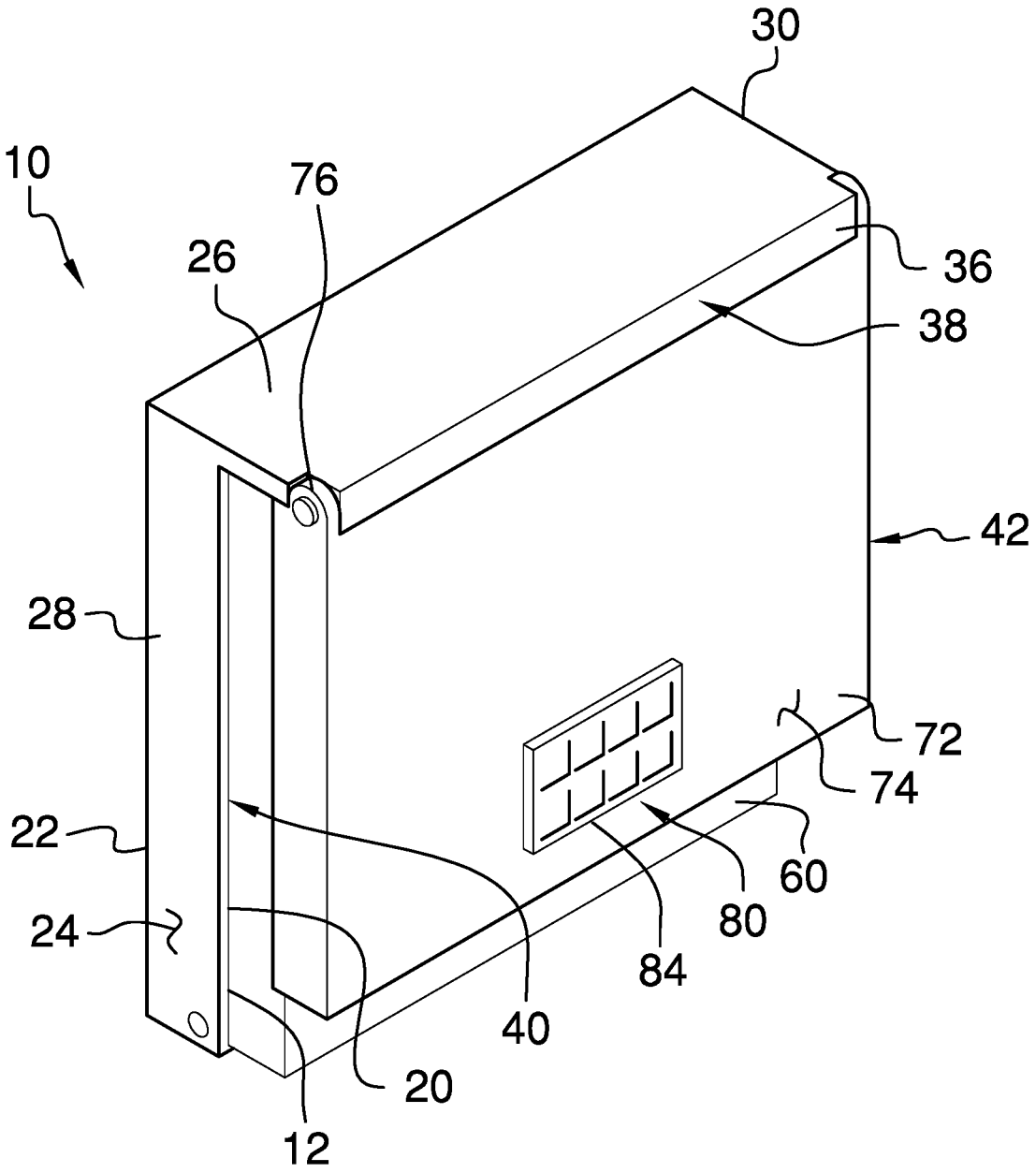
FIG. 1 is a front perspective view of a collapsible delivery storage assembly according to an embodiment of the disclosure.
Figure 2:
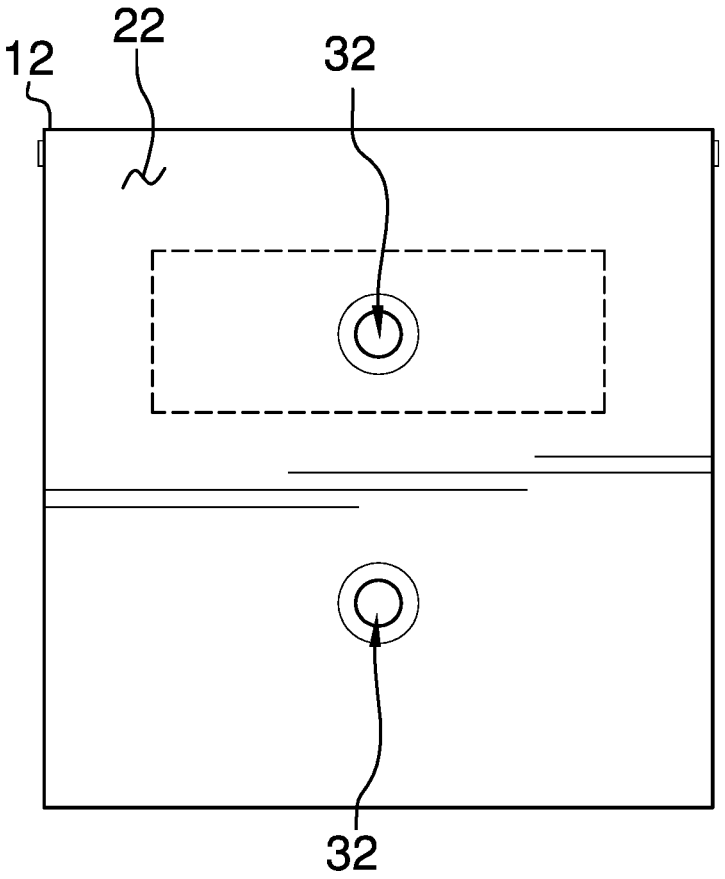
FIG. 2 is a back view of an embodiment of the disclosure.
Figure 3:
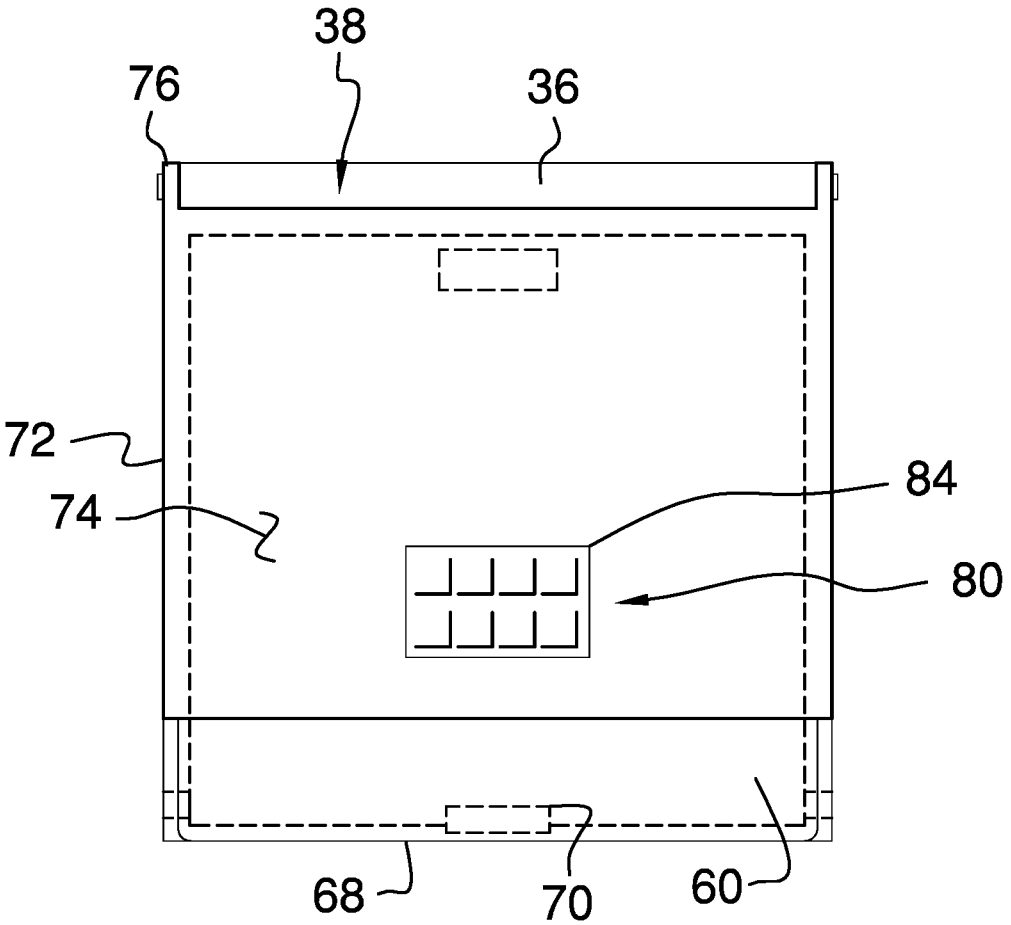
FIG. 3 is a front phantom view of an embodiment of the disclosure.
Figure 4:
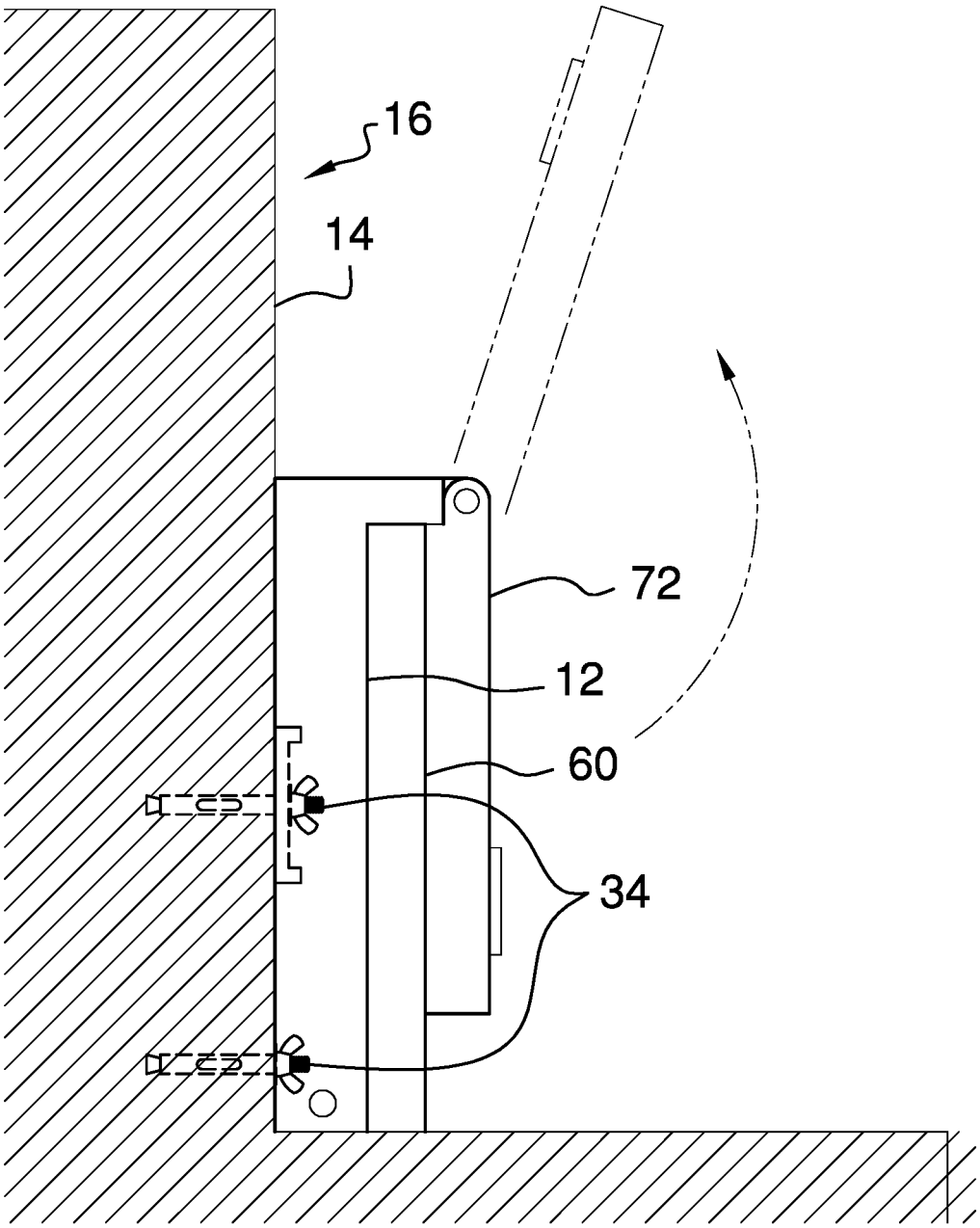
FIG. 4 is a perspective in-use view of an embodiment of the disclosure showing a storage unit in a collapsed position.
Figure 5:
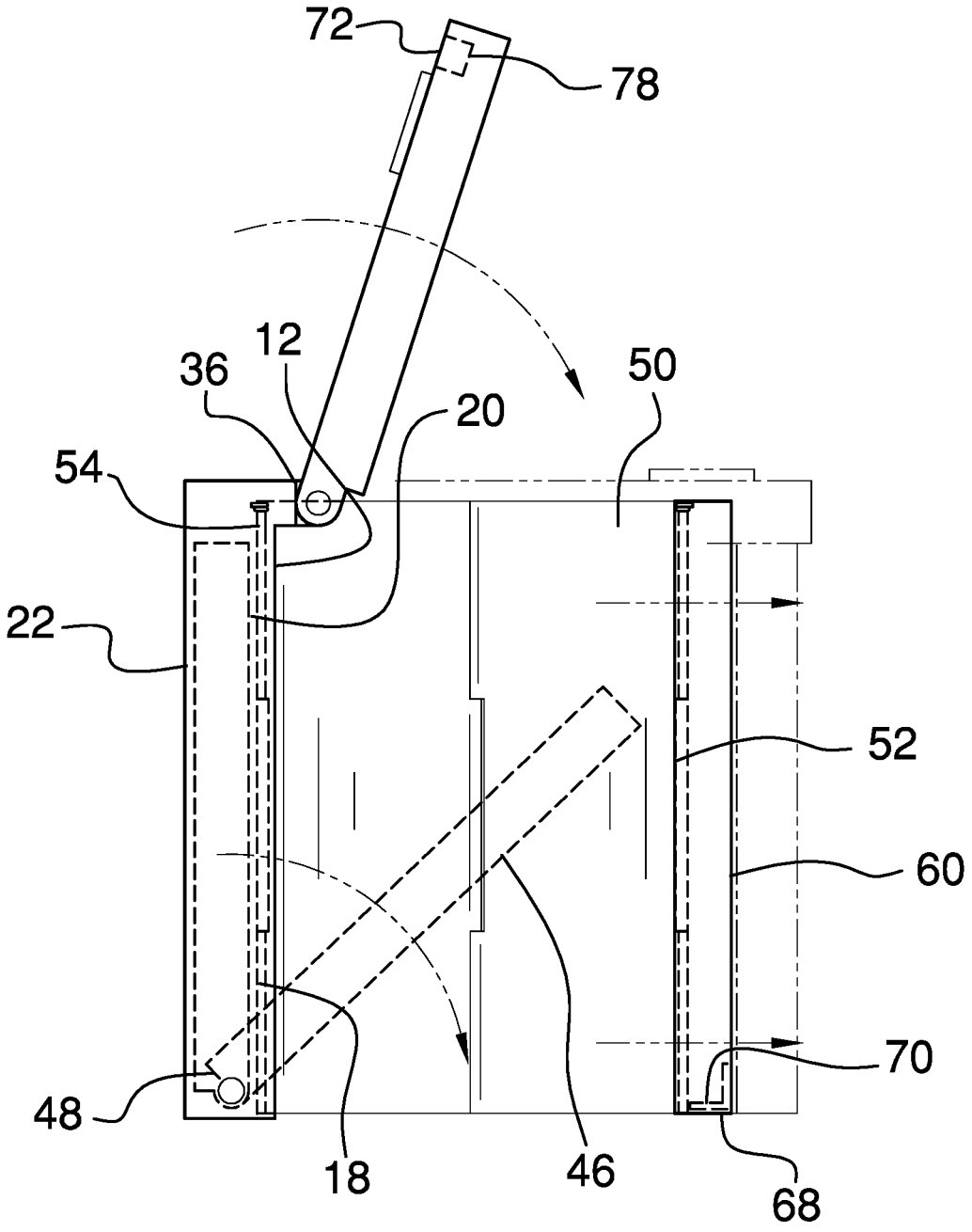
FIG. 5 is a right side phantom view of an embodiment of the disclosure showing a storage unit being urged into a deployed position.
Figure 6:
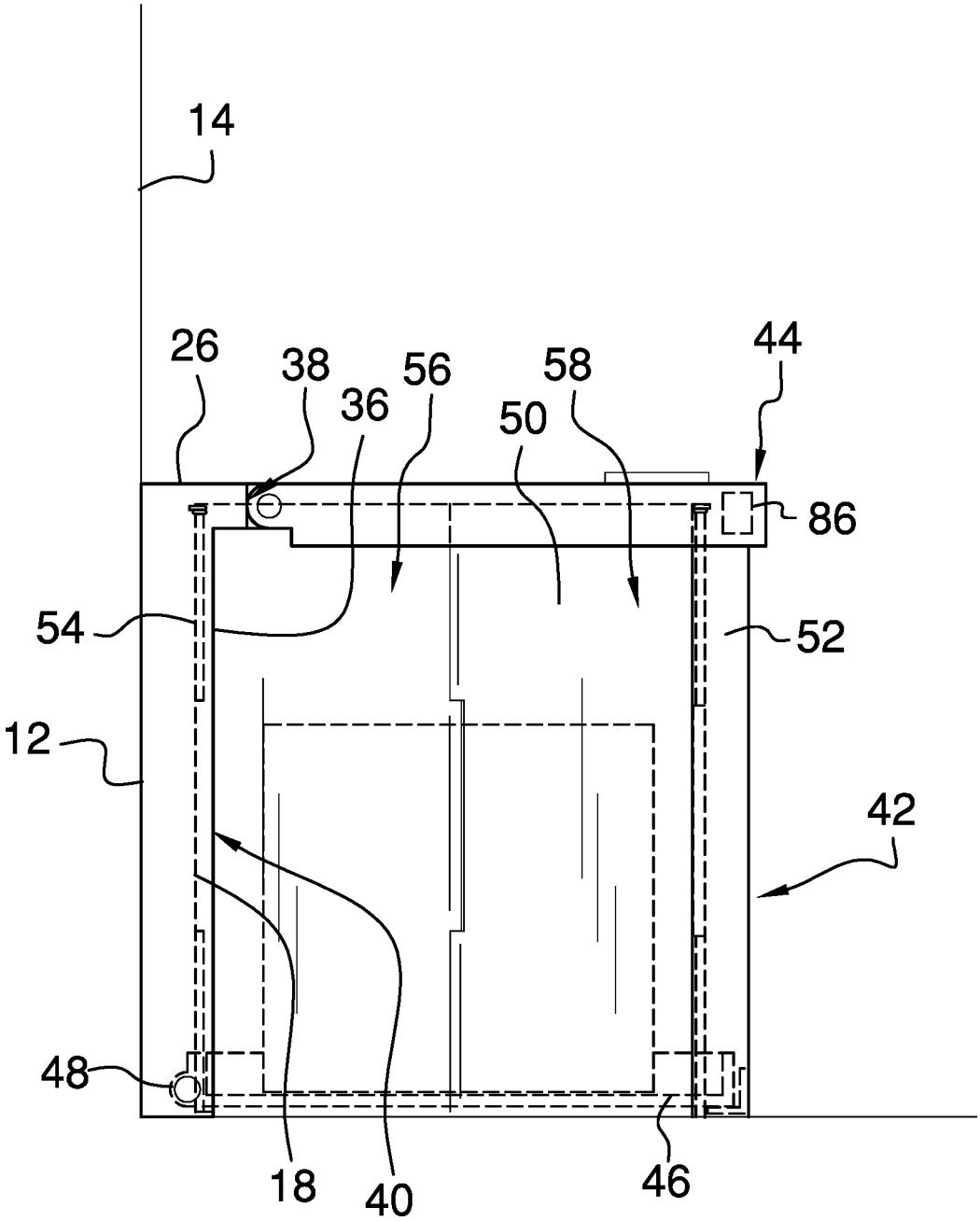
FIG. 6 is a phantom perspective view of an embodiment of the disclosure showing a package being stored in a storage unit.
Figure 7:
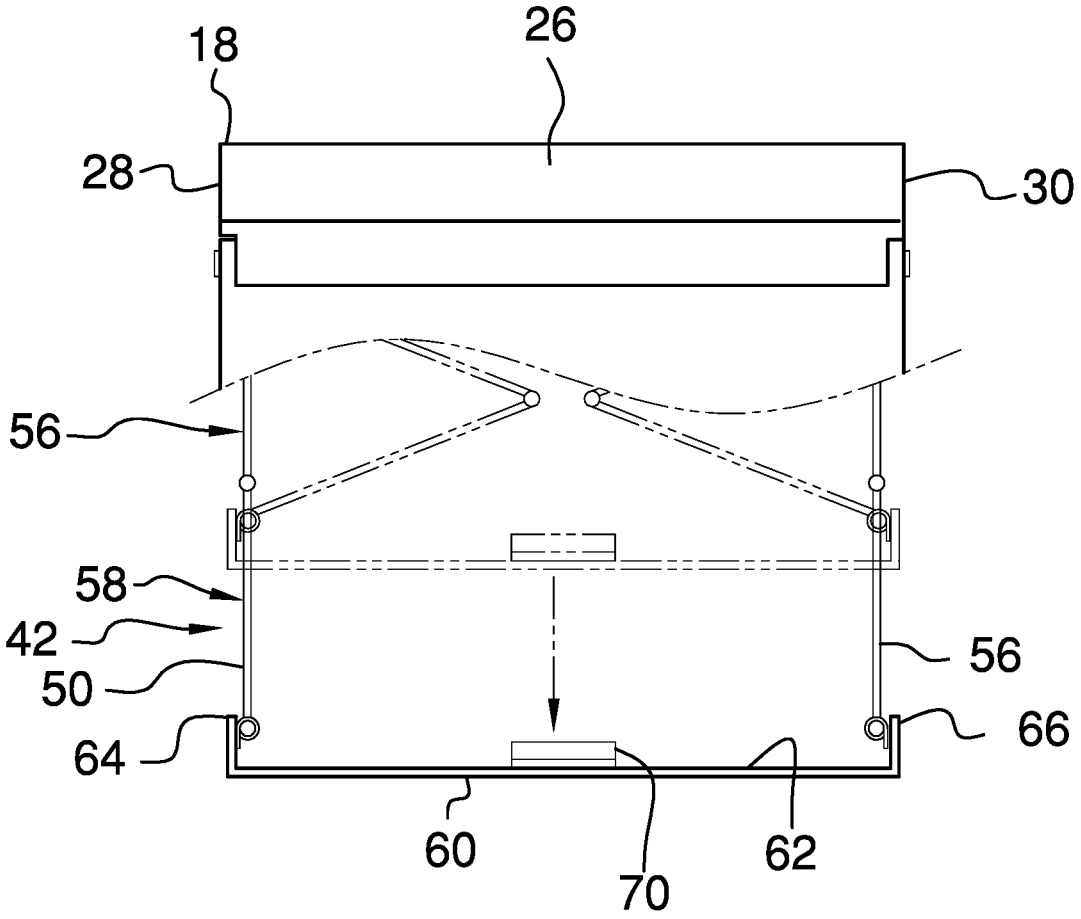
FIG. 7 is a top cut-away view of an embodiment of the disclosure showing a storage unit being urged into a deployed position.
Figure 8:
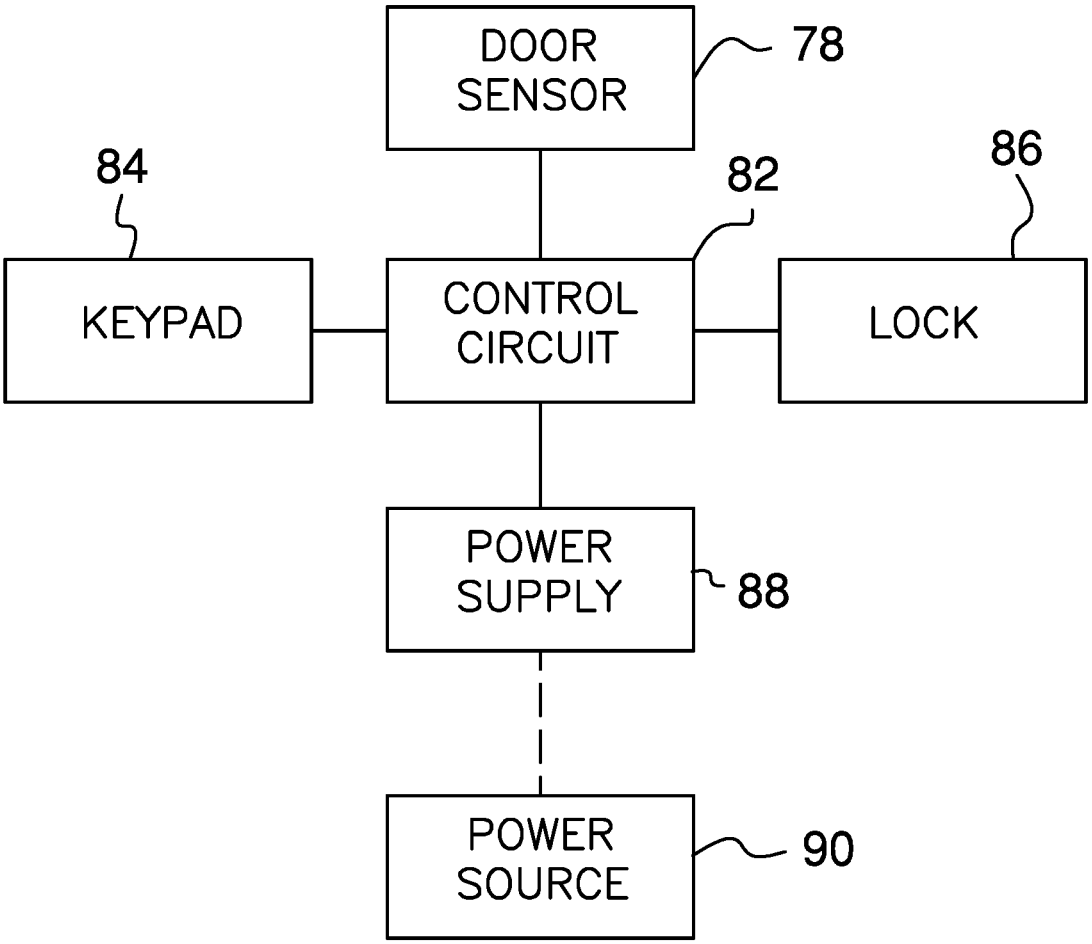
FIG. 8 is a schematic view of an embodiment of the disclosure.

With reference now to the drawings, and in particular to FIGS. 1 through 8 thereof, a new storage device embodying the principles and concepts of an embodiment of the disclosure and generally designated by the reference numeral 10 will be described.

As best illustrated in FIGS. 1 through 8, the collapsible delivery storage assembly 10 generally comprises a panel 12 that is mounted to an exterior wall 14 of a building 16. The building 16 may be a residence, an office building 16 and any other building 16 that is occupied by people. Additionally, the panel 12 may be positioned adjacent to a front door of the building 16 and the panel 12 has a recess 18 therein.

The panel 12 has a first surface 20, a second surface 22 and a peripheral surface 24 extending therebetween, and the peripheral surface 24 has a top side 26, a first lateral side 28 and a second lateral side 30. The panel 12 has a pair of apertures 32 each extending through the first surface 20 and the second surface 22. A pair of fasteners 34, such as concrete anchors, screws and any other appropriate fastener for the construction of the building 16, is extended through each of the fasteners 34 and engages the exterior wall 14 of the building 16 to retain the panel 12 on the exterior wall 14. The first surface 20 has a lip 36 extending away therefrom, and the lip 36 is coextensive with and is aligned with the peripheral surface 24 to define the recess 18 in the panel 12. The lip 36 has a first portion 38 and a second portion 40, and the first portion 38 is aligned with the top side 26 of the peripheral surface 24 of the panel 12. Moreover, the first portion 38 extends further away from the first surface 20 of the panel 12 than the second portion 40.

A storage unit 42 is provided and the storage unit 42 is movably coupled to the panel 12. The storage unit 42 is positionable in a collapsed position having the storage unit 42 being positioned in the recess 18. Alternatively, the storage unit 42 is positionable in a deployed position such that the storage unit 42 defines a box 44. A package delivery, such as a parcel from UPS, FedEx or USPS, can be positioned in the box 44 when the package delivery is delivered to the building 16.

The storage unit 42 comprises a bottom wall 46 that has a back edge 48 which is hingedly coupled to the first surface 20 of the panel 12. The bottom wall 46 lies against the first surface 20 of the panel 12 when the storage unit 42 is positioned in the collapsed position having the bottom wall 46 being positioned in the recess 18. The bottom wall 46 extends away from the first surface 20 and the bottom wall 46 is horizontally oriented when the storage unit 42 is positioned in the deployed position. Thus, the bottom wall 46 defines a bottom of the box 44.

The storage unit 42 includes a pair of side walls 50 and each of the side walls 50 has a back edge 52 and a front edge 54. The back edge 52 of each of the side walls 50 is hingedly coupled to the first surface 20 of the panel 12, and the back edge 52 of each of the side walls 50 is aligned with and is coextensive with the lip 36 that is aligned with a respective one of the first 28 and second 30 lateral sides of the panel 12. Each of the side walls 50 has a first half 56 that is hingedly coupled to a second half 58.

Each of the side walls 50 is folded having the first half 56 lying flat against the bottom wall 46 and having the second half 58 lying against the first half 56 when the storage unit 42 is positioned in the folded position. Alternatively, each of the first half 56 and the second half 58 of each of the side walls 50 extends away from the first surface 20 of the panel 12 when the storage unit 42 is positioned in the deployed position. Thus, each of the side walls 50 defines opposite sides of the box 44.

The storage unit 42 includes a front wall 60 that has a primary surface 62, a first lateral edge 64, a second lateral edge 66 and a bottom edge 68. The front edge 54 of each of the side walls 50 is hingedly coupled to the primary surface 62 of the front wall 60. The primary surface 62 of the front wall 60 rests against the second portion 40 of each of the side walls 50 when the storage unit 42 is positioned in the collapsed position. Alternatively, the front wall 60 is spaced from the panel 12 when the storage unit 42 is positioned in the deployed position. Thus, the panel 12 defines a back of the box 44 and the front wall 60 defines a front of the box 44.

A support 70 is coupled to and extends away from the primary surface 62 of the front wall 60 and the support 70 is aligned with the bottom edge 68 of the front wall 60. The bottom wall 46 lies on the support 70 when the storage unit 42 is positioned in the deployed position. Thus, the support 70 supports the weight of the package when the package is positioned on the bottom wall 46. A door 72 is hingedly coupled to the panel 12 and the door 72 extends downwardly in front of the storage unit 42 when the storage unit 42 is positioned in the collapsed position. Alternatively, the door 72 lies on top of the storage unit 42 when the storage unit 42 is in the deployed position such that the door 72 closes the box 44.

The door 72 has a first surface 74 and a rear edge 76, and the rear edge 76 is hingedly coupled to the first portion 38 of the lip 36 on the panel 12. A door sensor 78 is coupled to the door 72 and the door sensor 78 engages the storage unit 42 when the door 72 is positioned to close the box 44. The door sensor 78 may be a switch or any electronic sensor that is capable of detecting when the door 72 is positioned to close the box 44. A combination lock 80 is coupled to the door 72 and the combination lock 80 releasably engages the storage unit 42 when the door 72 closes the box 44. In this way the combination lock 80 restricts access to the package in the box 44.

The combination lock 80 comprises a control circuit 82 that is positioned within the combination lock 80. The control circuit 82 receives a first input when the door sensor 78 engages the storage unit 42. The combination lock 80 includes a key pad 84 that is coupled to the first surface 74 of the door 72 and the key pad 84 is electrically coupled to the control circuit 82. The key pad 84 has a plurality of alpha-numeric keys for entering a pre-determined alpha-numeric code into the key pad 84. The control circuit 82 receives a second input when the pre-determined alpha-numeric code is successfully entered into the keypad. The pre-determined alpha-numeric code may be any sequence of digits, letters or any conceivable combination thereof that is chosen by a user. Additionally, the key pad 84 may include a program button for programming the pre-determined alpha-numeric code into the control circuit 82.

A lock 86 is movably coupled to the door 72 and the lock 86 is electrically coupled to the control circuit 82. The lock 86 is turned on to engage the front wall 60 when the control circuit 82 receives the first input. In this way the door 72 is lock 86*ed* to inhibit the package from being removed from the box 44. The lock 86 is turned off to disengage the front wall 60 when the control circuit 82 receives the second input. Thus, the door 72 can be opened to facilitate the package to be removed from the box 44. The lock 86 may be an electric solenoid or other electronic lock.

A power supply 88 is coupled to the combination lock 80 and the power supply 88 is electrically coupled to the control circuit 82. The power supply 88 is electrically coupled to a power source 90 that may comprise an electrical system of the building 16, a female electrical outlet and any other source of electrical power. Additionally, the power supply 88 may include a power cord extending between the panel 12 and the power source 90.

In use, the panel 12 is mounted to the exterior wall 14 of the building 16 near the front door 72 of the building 16 or other location for receiving package deliveries. The pre-determined alpha-numeric code is programmed into the control circuit 82 with the keypad. The door 72 is lifted upwardly and the front wall 60 of the storage unit 42 is pulled forwardly from the panel 12. Thus, each of the side walls 50 unfolds and the bottom wall 46 falls downwardly onto the support 70 to define the box 44 for receiving the package delivery.

The package delivery person places the package into the box 44 and closes the door 72. The door sensor 78 engages the front wall 60 and the control circuit 82 receives the first input thereby turning the lock 86 on to lock 86 the door 72. In this way the package is lock 86*ed* in the box 44 thereby inhibiting the package from being stolen. The pre-determined alpha-numeric code is entered into the keypad and the control circuit 82 receives the second input to unlock 86 the door 72. In this way the package can be retrieved from the box 44. The alpha-numeric code is communicated to subsequent package delivery persons to allow them to open the door 72 to place the package in the box 44. The bottom wall 46 is tipped against the panel 12 and the front wall 60 is urged toward the panel 12 to collapse the box 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A collapsible delivery storage assembly being configured to be mounted on an exterior wall of a building for receiving package deliveries, said assembly comprising:

a panel being mounted to an exterior wall of a building, said panel having a recess therein;

a storage unit being movably coupled to said panel, said storage unit being positionable in a collapsed position having said storage unit being positioned in said recess, said storage unit being positionable in a deployed position such that said storage unit defines a box wherein said box is configured to have a package delivery positioned therein;

a door being hingedly coupled to said storage unit to close said box;

a combination lock being coupled to said door, said combination lock releasably engaging said storage unit when said door closes said box wherein said combination lock is configured to restrict access to the package in said box; and wherein said panel has a first surface, a second surface and a peripheral surface extending therebetween, said peripheral surface having a top side, a first lateral side and a second lateral side, said panel having a pair of apertures each extending through said first surface and said second surface.

2. The assembly according to claim 1, wherein said first surface has a lip extending away therefrom, said lip being coextensive with and being aligned with said peripheral surface to define said recess in said panel.

3. The assembly according to claim 2, wherein said lip has a first portion and a second portion, said first portion being aligned with said top side of said peripheral surface of said panel, first portion extending further away from said first surface of said panel than said second portion.

4. The assembly according to claim 1, wherein said storage unit comprises a bottom wall having a back edge being hingedly coupled to said first surface of said panel, said bottom wall lying against said first surface of said panel when said storage unit is positioned in said collapsed position having said bottom wall being positioned in said recess, said bottom wall extending away from said first surface and being horizontally oriented when said storage unit is positioned in said deployed position such that said bottom wall defines a bottom of said box.

5. The assembly according to claim 4, further comprising a pair of side walls, each of said side walls having a back edge and a front edge, said back edge of each of said side walls being hingedly coupled to said first surface of said panel, said back edge of each of said side walls being aligned with and being coextensive with said lip that is aligned with a respective one of said first and second lateral sides of said panel.

6. The assembly according to claim 5, wherein each of said side walls has a first half being hingedly coupled to a second half, each of said side walls being folded having said first half lying against said bottom wall and having said second half lying against said first half when said storage unit is positioned in said folded position, each of said first half and said second half of each of said side walls extending away from said first surface of said panel when said storage unit is positioned in said deployed position such that each of said sidewalls defines opposite sides of said box.

7. The assembly according to claim 6, further comprising a front wall having a primary surface, a first lateral edge, a second lateral edge and a bottom edge, said front edge of each of said sidewalls being hingedly coupled to said primary surface of said front wall, said primary surface resting against said second portion of each of said sidewalls when said storage unit is positioned in said collapsed position, said front wall being spaced from said panel when said storage unit is positioned in said deployed position having said panel defining a back of said box and having said front wall defining a front of said box.

8. The assembly according to claim 7, further comprising a support being coupled to and extending away from said primary surface of said front wall, said support being aligned with said bottom edge of said front wall, said bottom wall lying on said support when said storage unit is positioned in said deployed position wherein said support is configured to support the package when the package is positioned on said bottom wall.

9. The assembly according to claim 8, wherein said door is hingedly coupled to said panel, said door extending downwardly in front of said storage unit when said storage unit is positioned in said collapsed position, said door lying on top of said storage unit when said storage unit is in said deployed position such that said door closes said box, said door having a first surface and a rear edge, said rear edge being hingedly coupled to said first portion of said lip on said panel.

10. The assembly according to claim 9, further comprising a door sensor being coupled to said door, said door sensor engaging said storage unit when said door is positioned to close said box.

11. The assembly according to claim 10, wherein said combination lock comprises a control circuit being positioned within said combination lock, said control circuit receiving a first input when said door sensor engages said storage unit.

12. The assembly according to claim 11, further comprising a key pad being coupled to said first surface of said door, said key pad being electrically coupled to said control circuit, said key pad having a plurality of alpha-numeric keys for entering a pre-determined alpha-numeric code into said key pad, said control circuit receiving a second input when said pre-determined alpha-numeric code is successfully entered into said keypad.

13. The assembly according to claim 12, further comprising a lock being movably coupled to said door, said lock being electrically coupled to said control circuit, said lock being turned on to engage said front wall when said control circuit receives said first input to lock said door wherein said door is configured to inhibit the package from being removed from said box, said lock being turned off to disengage said front wall when said control circuit receives said second input wherein said door is configured to facilitate the package to be removed from said box.

14. The assembly according to claim 11, further comprising a power supply being coupled to said combination lock, said power supply being electrically coupled to said control circuit, said power supply being electrically coupled to a power source comprising an electrical system of the building.

15. A collapsible delivery storage assembly being configured to be mounted on an exterior wall of a building for receiving package deliveries, said assembly comprising:

a panel being mounted to an exterior wall of a building, said panel having a recess therein, said panel having a first surface, a second surface and a peripheral surface extending therebetween, said peripheral surface having a top side, a first lateral side and a second lateral side, said panel having a pair of apertures each extending through said first surface and said second surface, said first surface having a lip extending away therefrom, said lip being coextensive with and being aligned with said peripheral surface to define said recess in said panel, said lip having a first portion and a second portion, said first portion being aligned with said top side of said peripheral surface of said panel, first portion extending further away from said first surface of said panel than said second portion;

a storage unit being movably coupled to said panel, said storage unit being positionable in a collapsed position having said storage unit being positioned in said recess, said storage unit being positionable in a deployed position such that said storage unit defines a box wherein said box is configured to have a package delivery positioned therein, said storage unit comprising:

a bottom wall having a back edge being hingedly coupled to said first surface of said panel, said bottom wall lying against said first surface of said panel when said storage unit is positioned in said collapsed position having said bottom wall being positioned in said recess, said bottom wall extending away from said first surface and being horizontally oriented when said storage unit is positioned in said deployed position such that said bottom wall defines a bottom of said box;

a pair of side walls, each of said side walls having a back edge and a front edge, said back edge of each of said side walls being hingedly coupled to said first surface of said panel, said back edge of each of said side walls being aligned with and being coextensive with said lip that is aligned with a respective one of said first and second lateral sides of said panel, each of said side walls having a first half being hingedly coupled to a second half, each of said side walls being folded having said first half lying against said bottom wall and having said second half lying against said first half when said storage unit is positioned in said folded position, each of said first half and said second half of each of said side walls extending away from said first surface of said panel when said storage unit is positioned in said deployed position such that each of said sidewalls defines opposite sides of said box;

a front wall having a primary surface, a first lateral edge, a second lateral edge and a bottom edge, said front edge of each of said sidewalls being hingedly coupled to said primary surface of said front wall, said primary surface resting against said second portion of each of said sidewalls when said storage unit is positioned in said collapsed position, said front wall being spaced from said panel when said storage unit is positioned in said deployed position having said panel defining a back of said box and having said front wall defining a front of said box; and a support being coupled to and extending away from said primary surface of said front wall, said support being aligned with said bottom edge of said front wall, said bottom wall lying on said support when said storage unit is positioned in said deployed position wherein said support is configured to support the package when the package is positioned on said bottom wall;

a door being hingedly coupled to said panel, said door extending downwardly in front of said storage unit when said storage unit is positioned in said collapsed position, said door lying on top of said storage unit when said storage unit is in said deployed position such that said door closes said box, said door having a first surface and a rear edge, said rear edge being hingedly coupled to said first portion of said lip on said panel;

a door sensor being coupled to said door, said door sensor engaging said storage unit when said door is positioned to close said box; and a combination lock being coupled to said door, said combination lock releasably engaging said storage unit when said door closes said box wherein said combination lock is configured to restrict access to the package in said box, said combination lock comprising:

a control circuit being positioned within said combination lock, said control circuit receiving a first input when said door sensor engages said storage unit;

a key pad being coupled to said first surface of said door, said key pad being electrically coupled to said control circuit, said key pad having a plurality of alpha-numeric keys for entering a pre-determined alpha-numeric code into said key pad, said control circuit receiving a second input when said pre-determined alpha-numeric code is successfully entered into said keypad;

a lock being movably coupled to said door, said lock being electrically coupled to said control circuit, said lock being turned on to engage said front wall when said control circuit receives said first input to lock said door wherein said door is configured to inhibit the package from being removed from said box, said lock being turned off to disengage said front wall when said control circuit receives said second input wherein said door is configured to facilitate the package to be removed from said box; and a power supply being coupled to said combination lock, said power supply being electrically coupled to said control circuit, said power supply being electrically coupled to a power source comprising an electrical system of the building.

* * * * *